United States Patent [19]

Michel et al.

[11] Patent Number: 4,605,487

[45] Date of Patent: Aug. 12, 1986

[54] USE OF METHANE, METHANE AND HYDROGEN, OR NATURAL GAS FOR PYROLYSIS GAS

[75] Inventors: Wolfgang Michel, Magdeburg; Heinz Paul, Möser; Andreas Rummel, Dessau; Gero Seher, Wernigerode; Manfred Ossowski, Magdeburg; Irmtrud Heberlein, Möser; Dieter Köstler; Frank Wilhelm, both of Magdeburg, all of German Democratic Rep.

[73] Assignee: VEB Schwermaschinenbau Karl Liebknecht Magdeburg, Magdeburg, German Democratic Rep.

[21] Appl. No.: 654,813

[22] Filed: Sep. 26, 1984

[30] Foreign Application Priority Data

Dec. 22, 1983 [DD] German Democratic Rep. ..... 2584498

[51] Int. Cl.[4] ..... C10G 1/00

[52] U.S. Cl. ..... 208/408; 208/409; 208/951

[58] Field of Search ..... 208/8 R, 11 R

[56] References Cited

U.S. PATENT DOCUMENTS

| | | | |
|---|---|---|---|
| 2,709,675 | 5/1955 | Phinney | 208/8 R |
| 3,997,423 | 12/1976 | Greene | 208/8 R |
| 4,010,090 | 3/1977 | Fey et al. | 208/8 R |
| 4,064,018 | 12/1977 | Choi | 208/8 R |
| 4,157,245 | 6/1979 | Mitchell et al. | 208/8 R |
| 4,200,494 | 4/1980 | Welter et al. | 208/8 R |
| 4,326,944 | 4/1982 | Meyer et al. | 208/8 R |
| 4,404,083 | 9/1983 | Vasalos | 208/8 R |

*Primary Examiner*—John Doll
*Assistant Examiner*—Lance Johnson
*Attorney, Agent, or Firm*—Jordan and Hamburg

[57] ABSTRACT

Method for the production of liquid products, particularly, tar, from organic bulk materials.

The invention relates to a method, whereby in an apparatus in one or a multiple of refining stages, organic bulk goods are refined to economically significant base materials, so that they are suitable, either directly or indirectly, for the production of gasifier or diesel fuel.

The technical object is to utilize a fluidizing medium, with the help of which it is possible to produce, in a reaction chamber, an increased yield of liquid products, especially tar.

According to the invention, the problem is solved by supplying a hydrocarbonaceous gas, especially a gas containing methane and hydrogen, as a fluidizing medium in the individual refining stages, whereby, under the particular refining conditions, there results a decrease of the portion of methane and hydrogen, and a comparative increase of the portion of the liquid product, especially of the portion of tar. Furthermore, the portion of the components which boil easier, short-chained hydrocarbons, are significantly increased in the produced liquid product.

4 Claims, No Drawings

USE OF METHANE, METHANE AND HYDROGEN, OR NATURAL GAS FOR PYROLYSIS GAS

BACKGROUND OF THE INVENTION AND PRIOR ART STATEMENT

The invention relates to a method for the production of liquid products, particularly, tar, from organic bulk materials. The method is intended for an apparatus having one or a multitude of refining stages in the coal processing or related industry.

Methods for the prior production of tar are known, whereby coke and gas are produced as by-products. The publication DD-PS No. 48389, for instance, refers to a two-stage method for the short-interval low temperature carbonization of unbriquetted, solid fuels high in inerts, with an apparatus which essentially comprises a dryer and a low temperature carbonization aggregate, and whereby in both apparatus an individual homogeneous fluidized bed is built up over an influx floor. The fluidized beds receive their heat supply, whereby low temperature carbonization gas is carbonized to flue gas in a carbonization chamber, whereby to the fluidizing medium for the dryer is added a part of the vapors of the dryer, and to the fluidizing medium for the carbonization aggregate is added cold low temperature carbonization gas. On the side of the gas, between the dryer and the low temperature carbonization aggregate, is provided a filter which removes the dust from the mixture of vapors and flue gas transported out of the dryer. The removed dust is added via an immersion pipe slightly above the influx floor to the fluidized bed of the low temperature carbonization aggregate.

A modified method, intended for increasing the yield of light liquid products, provides for the injection of heavier hydrocarbons, such as, for instance, residual oils, asphalts, and the like, into the fluidized bed of the low temperature carbonization aggregate.

A further characteristic of the invention consists in transferring the low temperature carbonization gas recovered from the low temperature carbonization aggregate selectively either to a filter or to a cracking apparatus, in order to perform a cracking of the tar vapors and to remove coke dust.

Subsequently thereof, the low temperature carbonization gas is cooled in a waste heat boiler and transferred to a condensation and benzene removal chamber. The low temperature carbonization gas treated in this way is utilized as heating and/or as rinsing gas. The low temperature carbonization gas produced in the cracking apparatus differs from the low temperature carbonization gas produced in the conventional way, insofar, that the tar yield is reduced in favor of lighter products and gas.

The disadvantages of the described method are that charging the dust from the filter into the fluidized bed of the low temperature carbonization aggregate leads to an enrichment of the dust content of the tar vapors forming therein, whereby an unfavorable ratio develops between the heavy tar low in dust and the tar containing dust. Furthermore, it also increases the cost of auxiliary agents, because in accordance with the method, heavier hydrocarbons are injected into the fluidized bed for the purpose of increasing the tar yield.

Furthermore, in a separate stage of the method, there exists the possibility of cracking the tar vapors, and increasing the portion of the components which boil easier. The refining of the low temperature carbonization gas thereby occurs subsequently in various reaction chambers, so that the cost of the apparatus and the system engineering is comparatively high.

In addition, a method for the rapid pyrolysis of lignite in the fluidized bed (WP C 10 B/2490798) has been proposed. It has the objective of producing the three main products, coke, gas, and tar of high quality and high yield.

The method works in two stages with a dryer and a pyrolysis reactor, whereby in each of the two apparatus a fluidized bed is built up over an influx floor. The heat supply to the fluidized beds building up in the dryer occurs by a specific mixed gas (WP F 23 C/2530430), and in the pyrolysis reactor, firstly, directly via the heated fluidizing medium and, secondly, indirectly via a nest of boiler heat transfer pipes.

As a fluidizing medium for the pyrolysis reactor, a low temperature carbonization gas alien to the pyrolysis has been proposed. A special feature of the invention is that the dust from the dryer is not transferred into the pyrolysis reactor, but is removed from the actual work cycle of the method, and is utilized in by-processes. This is meant to shift the equilibrium in the tar formation phase in favor of the tar low in dust, which is especially suitable for electrode coke production.

SUMMARY OF THE INVENTION

The object of the invention is to refine organic bulk goods, according to the fluidized bed principle, in an apparatus having one or several stages, to economically significant base materials. Its aim is to reduce the equipment and system engineering cost, as well as the portion of the auxiliary agents required by the method.

The technical object is to utilize a fluidizing medium, with the help of which it is possible to produce, in a reaction chamber, an increased yield of liquid products, especially tar.

A further object is to refine organic bulk goods to economically significant base materials, so that they are suitable, either directly or indirectly, for the production of gasifier or diesel fuel.

These and other objects and advantages of the present invention will become evident from the description which follows.

In summary, the present invention is directed to a method for the production of liquid products, particularly tar, from organic bulk materials. The invention relates to a method, whereby in an apparatus in one or a multitude of refining stages, organic bulk goods are refined to economically significant base materials, so that they are suitable, either directly or indirectly, for the production of gasifier or diesel fuel. The technical objective is to utilize a fluidizing medium, with the help of which it is possible to produce, in a reaction chamber, an increased yield of liquid products, especially tar. According to the invention, the problem is solved by supplying a hydrocarbonaceous gas, especially a gas containing methane and hydrogen, as a fluidizing medium in the individual refining stages, whereby, under the particular refining conditions, there results a decrease of the portion of methane and hydrogen, and a comparative increase of the portion of the liquid product, especially of the portion of tar. Furthermore, the portion of the components which boil easier, short-chained hydrocarbons, are significantly increased in the produced liquid product.

Basically, the present method for the production of liquid products, especially, tar, from organic bulk goods according to the fluidized bed principle, entails a procedural sequence in which a hydrocarbonaceous gas, especially a gas containing only methane, or methane and hydrogen, is conveyed as a fluidizing medium in the individual refining stages; the individual refining conditions cause a decrease of the portion of methane and hydrogen in the fluidizing medium and an increase of the portion of the liquid product, especially of tar; and the portion of the components which boil easier are significantly increased in the produced liquid product. Typically, the fluidizing medium is natural gas, and a pyrolysis is performed under a slight excess pressure and a reaction temperature in the range of about 550° C. to 600° C.

The invention is therefore based on the general object of providing a method for the production of liquid products, especially, tar, from organic bulk goods according to the fluidization bed principle, whereby a fluidizing medium is utilized, which causes a refining of the charge of goods, for the increased yield of liquid products, and whereby the liquid product formation and refining phase take place in one reaction chamber. The produced liquid products should be especially suitable for the direct or indirect production of gasifier and diesel fuel.

According to the invention, the technical object is solved by conveying a hydrocarbonaceous gas, especially a gas containing only methane or a gas containing methane and hydrogen, as a fluidizing medium in the individual refining stages. According to the individual refining conditions, this causes a decrease of the portion of methane and hydrogen in the fluidizing medium and an increase of the portion of the liquid product, especially of tar.

By means of the method of the invention, the portion of the components which boil easier is considerably increased in the produced liquid product.

A special feature of the invention provides that natural gas is added as a fluidizing medium to the individual refining stages.

Another embodiment specifies the refining conditions as a pyrolysis at a slight excess pressure and reaction temperatures of approximately 550° C.-600° C.

A further configuration characterizes the production of liquid products by a refining in all higher pressure ranges and the corresponding temperature conditions, as well as the production of liquid products by a refining in vacuum ranges with the corresponding temperature conditions which correspond to the temperature conditions of the normal range of 550° C.-600° C.

DETAILED DESCRIPTION OF A PREFERRED EMBODIMENT

The invention will now be explained in detail by means of an exemplified embodiment.

The method according to the invention serves to refine organic bulk goods in the fluidized bed, in order to produce liquid products thereof, especially tar, from which can be produced, either directly or indirectly, gasifier and diesel fuel. The method is intended for an apparatus having one or several refining stages. The organic bulk goods are dried in the conventional way and subsequently refined in the fluidized bed. Thereby is proposed the utilization of gas containing methane and hydrogen, especially natural gas, as a fluidizing medium. The refining conditions in the individual refining stages can be randomly selected. It is possible, for instance, to perform a pyrolysis at a slight excess pressure and reaction temperatures of 550° C.-600° C. The method, however, is also realizable, if the refining is performed in all higher pressure ranges and at temperatures which correspond to the temperatures of 550° C.-600° C. under normal conditions. It is also not to be excluded, to perform a refining in vacuum ranges at the corresponding reaction temperatures.

Experiments have shown that, under specific refining conditions, a decrease of the portion of methane and hydrogen occurs in the fluidizing medium, and that the portion of the liquid product increases in comparison to conventional methods, whereby in the liquid product, especially in tar, the portion of the components which boil easier is again considerably increased.

The result of the performed experiments confirm that, with the help of the method according to the invention, the portion of the short-chained hydrocarbon compounds in the resulting tar has been considerably increased. In comparison to conventional methods, the method provides the essential advantage of producing economically significant base materials from organic bulk materials so that, either directly or indirectly, gasifier and diesel fuels can be produced from it. The portion of auxiliary agents is thereby insignificant. In comparison to known methods, the apparatus and system engineering cost is thereby considerably lowered, because the reactions take place in one reaction chamber, whereas in other methods they take place subsequently in various reaction chambers.

It will thus be seen that there is provided a method for the production of liquid products, particularly, tar, from organic bulk materials, which attains the various objects of the invention and is well adapted for the conditions of practical use. As numerous alternatives within the scope of the present invention will occur to those skilled in the art, besides those alternatives, variations, embodiments and equivalents mentioned supra, it will be understood that the invention extends fully to all such alternatives and the like, and is to be limited only by the scope of the appended claims, and functional and structural equivalents thereof.

It is therefore claimed:

1. A method for the production of a liquid product from an organic bulk material which consists essentially of:

(a) providing a charge of dry organic bulk material, said charge being suitable for fluidization in a fluidized bed reaction chamber;

(b) passing said charge into a reaction chamber capable of containing a fluidized bed;

(c) conveying only a gas stream consisting essentially of methane or methane and hydrogen or natural gas into and through said charge in said reaction chamber, said gas stream being a fluidizing medium within said reaction chamber, so that said charge is fluidized within said reaction chamber;

(d) maintaining an elevated pyrolysis reaction temperature within said reaction chamber containing essentially only said dry organic bulk material and said gas stream, whereby the concentration of the methane in said fluidizing medium is decreased, the proportion of liquid product formed in said fluidized charge in said reaction chamber is increased, and said liquid product has a substantially increased proportion of low-boiling short-chained hydrocarbon components, liquid product formation and refining of the liquid product thereby both taking place in said reaction chamber;

(e) withdrawing from said reaction chamber a refined liquid product in said reaction chamber; and (f) withdrawing a spent gas stream from said reaction chamber.

2. The method of claim 1, in which the pyrolysis reaction temperature in step (d) is in the range of about 550° C. to 600° C., and the pressure in the reaction chamber during step (d) is slightly above atmospheric pressure.

3. The method of claim 1, in which the liquid product consists essentially of tar suitable for the production of gasifier and diesel fuel.

4. The method of claim 3, in which the organic bulk material consists essentially of coal.

* * * * *